United States Patent [19]

Brasch

[11] 4,233,344

[45] Nov. 11, 1980

[54] METHOD OF IMPROVING THE ADHESION OF ELECTROLESS METAL DEPOSITS EMPLOYING COLLOIDAL COPPER ACTIVATOR

[75] Inventor: William Brasch, Commack, N.Y.

[73] Assignee: LeaRonal, Inc., Freeport, N.Y.

[21] Appl. No.: 926,392

[22] Filed: Jul. 20, 1978

[51] Int. Cl.[3] ..... C23C 3/02

[52] U.S. Cl. ..... 427/304; 427/97; 427/97; 427/305; 427/306

[58] Field of Search ..... 427/97, 98, 304–307

[56] References Cited

U.S. PATENT DOCUMENTS

| | | | |
|---|---|---|---|
| 3,884,704 | 5/1975 | Rantell et al. | 427/98 |
| 3,962,494 | 6/1976 | Nuzzi | 427/306 |
| 3,962,496 | 6/1976 | Leech | 427/306 |
| 3,982,045 | 9/1976 | Kukanskis | 427/306 |
| 3,993,799 | 11/1976 | Feldstein | 427/53 |
| 4,002,778 | 1/1977 | Bellis et al. | 427/98 |
| 4,020,197 | 4/1977 | Steffen | 427/304 |
| 4,042,730 | 8/1977 | Cohen et al. | 427/98 |
| 4,096,043 | 6/1978 | De Angelo | 427/306 |

FOREIGN PATENT DOCUMENTS

| | | | |
|---|---|---|---|
| 2335497 | 2/1974 | Fed. Rep. of Germany | 427/306 |

*Primary Examiner*—John D. Smith

*Attorney, Agent, or Firm*—Pennie & Edmonds

[57] ABSTRACT

The present invention relates to a method for promoting and improving the adhesion of an electroless metal deposit to the metal surface of a composite substrate having both a conductive metal area and an activated non-conductive surface. The process comprises treating such a substrate, subsequent to catalyzation or activation of the substrate, and prior to electroless metal deposition thereon, with an adhesion promotor compound or mixture of compounds.

5 Claims, No Drawings

METHOD OF IMPROVING THE ADHESION OF ELECTROLESS METAL DEPOSITS EMPLOYING COLLOIDAL COPPER ACTIVATOR

BACKGROUND OF THE INVENTION

It has been commercially desirable for many years to have plastic, glass, or other like non-conductive substrates provided with a metal coating or plating on its surface either as a continuous coat or as a patterned or discontinuous coating or plating. In addition, numerous related applications exist in regards to providing a metal coating or plating to composite substrates having both a conductive metal portion and a nonconductive portion, usually plastic. Such composite substrates are commonly comprised of a plastic sheet having a thin metal foil, usually copper, laminated or clad to the two sides of the plastic sheet leaving the non-conductive plastic sandwiched between two metal surfaces. Holes are usually drilled through the metal clad and the plastic, exposing the plastic where the holes are drilled. These composite substrates, after being electroplated, are used to produce printed circuit boards for electrical or electronic applications.

So-called printed circuit boards are produced by variations of two basic systems, one of which is referred to as the additive system and the other the subtractive system. The details of both are well known but, briefly, in the additive system the starting composition is comprised of plastic with no metal foil, and the metal circuit is then built up upon the non-conductive substrate in the desired pattern. In the subtractive method a non-conductive substrate, such as epoxy bonded fiberglass, has adhered to two sides thereof a metal cladding or laminate, most often copper. Holes are drilled through the copper laminate board exposing the plastic. It is then deburred, chemically cleaned and rinsed. The board is then treated with a dilute solution of hydrochloric acid, dipped into a catalyst, mostly commonly a palladium-tin catalyst, to activate the plastic for electroless deposits, rinsed in water, treated with an accelerator (generally fluoroborate based) to remove the tin compound, again rinsed and immersed into an electroless plating bath to electrically connect the two metal (copper) sides by plating the inside of the holes as well as the exposed sides and edges of the board. A plating resist is then applied in the circuit pattern desired. The board is then cleaned, electroplated with copper followed by solder, the resist removed with a solvent to expose the copper that is covered and this copper is removed by etching, thereby providing the desired circuit.

In all of such applications, the non-conductive portions of the substrate must be activated since neither electroless metal plating or electro metal plating can be carried out on the non-conductive portions of the substrate in its absence. The activation is followed by an electroless metal plating of a sufficient nature so that it will carry a current and permit subsequent electroplating.

It is, of course, not commercially feasible to treat such composite substrates to activate or catalyze only the non-conductive portions and as a result, the entire composite substrate is immersed or dipped into an activating solution or colloid. In this manner of processing such composite substrates, the non-conductive portions are not only activated, but the conductive or metal portions thereof are also contacted with the activating solutions or colloids. Unfortunately, the activating solutions coming into contact with the metal conductive portions of the composite substrate may contaminate the metal portions and this contamination seriously interferes with the bond of the subsequent electroless metal deposit which also deposits on the metal portions.

THE PRIOR ART

Most present commercial activating systems rely upon one or more of the noble metals (Au, Ag, Pt, Pd, Ir, Rh, Ru, and Os) particularly Pd, Pt, Ag, Au, and most commonly palladium. For example, one of the earliest methods of activating such substrates involved a two-step operation involving first immersion of the substrate in a stannous chloride solution followed by a second immersion in an acid palladium chloride solution. Subsequently a one-step process has been employed commercially, involving a colloidal dispersion of palladium and tin chloride salts as disclosed in U.S. Pat. No. 3,011,920 to Shipley. Still another one-step process is disclosed in U.S. Pat. No. 3,672,923 to Zeblisky which also utilizes noble metals, particularly palladium. One typical example involving the metal plating of plastics such as acrylonitrile—butadiene—styrene copolymers (ABS) involves the steps of first cleaning the plastic article in a strong alkali bath followed by etching the article in a chemical etching bath, frequently a chrome etch, which serves to enhance adherence of the metal coatings to the surface. Following the etching step the article is rinsed in water and dipped in hydrochloric acid to neutralize the chrome, rinsed again, and then placed in the activating solution (frequently referred to as a catalyst, seeder or sensitizer and referred to herein as an activator). The most widely used activator is the colloidal dispersion of palladium and tin chloride in accordance with, for instance, the above-mentioned U.S. Pat. No. 3,011,920. After activating, the article is again rinsed and then placed briefly in an accelerator to remove the tin (which tends to interfere with adherence), rinsed again, and placed in the conventional electroless metal bath. The noble or non-noble metal of the activating solution, such as palladium, serves to catalyze or activate the non-conductive substrate for the subsequent electroless plating bath. After a few minutes in the electroless metal bath, the article will have a very thin coating of the selected metal of the bath thereon. It is then rinsed and the article may then be further plated with the same or another metal either by well known electroplating processes or by further electroless metal plating.

The use of the colloidal palladium activation systems on composite substrates generally does not significantly interfere with the bonding of the subsequent electroless metal plating on the metal portions thereof to inhibit commercial production. However, on occasion, such bonding is inferior or poor and the process of this invention can advantageously be used in such systems to insure adequate and good bonding of the electroless metal deposits on the metal portions of the composite substrates.

The use of colloidal dispersions of various metals, both noble and non-noble, in combination with or without additional agents to achieve catalyzation or activation of insulative substrates for subsequent electroless plating, is disclosed in many additional prior art patents, such as in U.S. Pat. No. 3,011,920 to Shipley, in U.S. Pat. No. 3,657,002 to Kenney, in U.S. Pat. Nos. 3,783,005 and 3,950,570 also issued to Kenney, in U.S.

Pat. No. 3,993,799 issued to Feldstein, and in U.S. Pat. No. 3,958,048 to Donovan. The problem of adhesion of an electroless metal deposit to the conductive metal portions of a composite substrate when a non-noble metal is used to activate the non-conductive portions of a composite substrate is more pronounced and the invention is more advantageously adaptable in this area and particularly where the activator is not a noble metal and the electroless metal bath contains copper.

Although the non-noble metal, e.g. copper, activating colloids referred to in the above patents are metal oxide colloids and an oxide is deposited on to the substrate, it is believed that the ultimate activation of the non-conduction portion of the substrate is actually the metal per se as disclosed in the patents, since it is also believed that the oxides themselves will not cause activation. For example, in the copper type activating colloidal system disclosed, it is the resulting copper metal on the substrate which causes the activation permitting subsequent electroless metal plating thereon.

SUMMARY OF THE INVENTION

The present invention relates to a method for promoting and improving the adhesion of an electroless metal deposit to the metal portions of a metal clad non-conductive composite substrate which comprises treating such a composite substrate, subsequent to catalyzation or activation of the substrate and prior to electroless deposition thereon, with an adhesion promotor compound or mixture of compounds. The invention relates especially to the method for promoting and improving the adhesion of the electroless metal deposit to the metal portion of a composite substrate having non-conductive areas, such as the copper metal in the case of the subtractive method as applied to copper clad printed circuit boards. It will be understood, however, that the present invention is applicable to promoting and improving the adhesion of the electroless metal deposit to all metal clad non-conductive substrates which have been previously treated by a catalyst or activator to permit electroless metal deposition on the non-conductive portions thereof.

DETAILED DESCRIPTION OF THE INVENTION

The compounds which promote or improve the adhesion of the electroless metal deposits to the metal portion of a composite substrate having non-conductive areas, subsequent to catalyzation or activation of the substrate and prior to electroless metal deposition thereon, are hydrazine hydrate, ammonium persulfate, or an alkali hydroxide such as sodium hydroxide, or a suitable mixture of the foregoing.

As noted above, the method of the present invention is carried out after the composite metal clad non-conductive substrate has been catalyzed or activated so as to permit a subsequent electroless metal deposit to occur upon the substrate. In the practice of this invention, it is desirable to first clean the composite non-conductive metal clade substrate in a manner which is well known to those skilled in the art. Thereafter, the composite substrate is catalyzed or activated as by treatment with a noble or a non-noble metal colloid or ionic solution as is described in, for instance, any of the above-discussed patents. After customary rinsing of the now activated non-conductive portions of the composite substrate, the same is then treated with a solution containing the above-listed compound or a suitable mixture of compounds. After again customary rinsing of the substrate which has been treated in accord with the present invention, the composite substrate is then immersed in an electroless bath under conditions which are also well known to those skilled in the art. After again rinsing these results a conducting substrate on which the electroless metal deposit is strongly, uniformly and permanently adhered not only to the non-conductive portions of the composite substrate but also to the metal portions thereof.

The conditions under which the activated or catalyzed composite substrate is treated with the compounds according to the present invention are not critical and may be carried out by immersing the substrate in the solution. It has been found desirable, however, to limit the immersion time of the substrate in the solution containing the compounds for a period of time not to exceed about 5 minutes. In the case of hydrazine hydrate the time may preferably be from about 1–3 minutes; in the case of ammonium persulfate the time should ordinarily not exceed about 15 seconds; and in the case of sodium hydroxide the time should ordinarily not exceed about 30 seconds. The exact times depend somewhat upon the concentrations of the respective compound or compounds in solution, as discussed below, and can be easily determined by one skilled in the art. If the immersion time is too short, good adhesion of the electroless metal deposit may not occur, and if the immersion time is too long, the activation of the non-conductive portions of the composite substrate may be unduly affected resulting in spotty electroless metal deposition on the activated non-conductive areas.

As noted, the compounds may be dissolved in an aqueous solution although non-aqueous solution, such as alcohols can be used, so long as such non-aqueous solutions do not otherwise interfere or adversely affect either the previous catalyzation or the subsequent electroless deposition.

The concentrations of the solutions containing the compound or compounds of the present invention are not especially critical. It has been found, however, that in the case of hydrazine hydrate it is desirable that the solution contain about 0.1% hydrazine hydrate by volume to saturation; in the case of ammumiun persulfate it is desirable that the solution contain about 0.5–10 grams of ammonium persulfate per liter of solution; and in the case of sodium hydroxide it is desirable that the solution contain about 0.1–5 grams of sodium hydroxide per liter of solution. It has been also found that if concentrations above those recited are employed, then the length of time during which the substrate is immersed or otherwise treated with the solution must be more carefully monitored and generally a somewhat shorter contact time than those listed above is necessary to prevent damage to the non-conductive areas. If solutions of lower concentrations are used, the immersion time should be correspondingly increased.

Although the hydrazine hydrate can be used as it is or at a higher pH, it is advantageous to adjust the pH of the hydrazine hydrate solution to a pH of about 7, although, even a further reduction of the pH to about 5 will also be operative. Since hydrazine hydrate is weakly basic in solution, pH adjustment may usually be accomplished by the addition of an acid such as a 1% solution of phosphoric acid. Using the neutralized hydrazine permits greater latitute in immersion times. In the case of ammonium persulfate, the resulting pH is about 3–5 and with sodium hydroxide, the resulting pH is about 8–11.

The temperature under which the treatment of the nonconductive substrate with the compound or compounds of this invention takes place is not critical and as a matter of convenience it is preferably carried out at room or ambient temperature conditions.

As can be seen especially from the preferred times and the concentration of the solutions for the treatment of the composite substrate in accord with this invention, the controls and operating conditions required in the case of neutralized hydrazine hydrate are far less stringent and rigorous then with the other compounds. Hence, neutralized hydrazine hydrate is the preferred adhesion promoter.

Electroless metal baths, particularly electroless copper baths are well known and generally any of these well known baths can be used for electroless deposition according to this invention. Although those skilled in the art may prefer certain electroless copper baths, applicant prefers electroless baths such as those disclosed in U.S. Pat. No. 3,361,580 to Schneble et al.

As previously noted, the compounds of the invention are particularly advantageous for promoting and improving the adhesion of an electroless copper deposit to the copper portions of composite copper clad plastic boards to be used in the manufacture of printed circuit boards. These boards, as is well known, are generally composed of a resinous sheet such as epoxy-glass, phenolic glass, phenolic paper, etc. having two thin sheets of copper foil laminated or clad to both sides of the plastic and having appropriate holes drilled through both copper sheets and the plastic. The plastic exposed by the holes must be electro plated with metal to provide electrical continuity throughout the circuit board. Thus, the exposed plastic portions of the laminate must be activated for electroless metal plating, and the resulting electroless deposit must fully and permanently adhere not only to such exposed plastic surfaces but also to the metal portion of the board.

As noted, it is a particularly novel feature of the present invention as it relates to catalyzed or activated printed composite boards that the compounds of the invention tend to promote and improve adhesion and uniformity of deposits of the subsequent electroless deposited metal to the metal portions of the composite boards. This is in clear distinction to the relatively poor bond that results between non-noble metal catalyzed or activated composite boards and the subsequent electroless metal deposit without the pretreatment in accord with this invention. It has been found that the application of the present invention not only increases adhesion of the electroless metal deposit to the metal portions of the substrates, but does not interfere, if properly applied, with the bonding and uniformity of electroless copper deposited to the activated non-conductive portions thereof. Not only does the present invention yield a strong bond, but the treatment in accord with this invention also brings about a uniform electroless metal deposit on the entire composite substrate which was found to be free of voids and to result in a coverage which is in all respects complete.

The theory of the efficacy of the present invention is not clearly understood although it is theorized that compounds of the present invention tend to strip or remove a film from the metal clad portion of the substrate, which film may have been formed by the catalyzing or activating colloid and which may otherwise be responsible for a decrease in the adhesive characteristics of the subsequent electroless metal deposit vis-a-vis the metal portion of the composite substrate.

The following examples are offered by way of illustration only.

EXAMPLE 1

A 2% by volume solution of hydrazine hydrate was prepared and neutralized with phosphoric acid into which was immersed, for a period of about 2 minutes, a composite substrate having both a copper clad portion and a non-conductive portion which had been activated by a copper type colloidal catalyst system resulting in the activation of the non-conductive portion by metallic copper. The temperature was about 70°-80° F. The substrate was then rinsed followed by electroless copper plating for a period of about 5-10 minutes at a temperature of about 100°-110° F. After rinsing, acid dipping, rinsing and drying, there resulted an exceptionally uniform and strong bond to the metal portions of the substrate without effecting the electroless copper bond to the non-conductive portions. Electroless copper plating on the same composite substrate without the pretreatment with the hydrazine resulted in a good bond to the non-conductive portions thereof but a non-uniform and poorly adhered electroless copper deposits on the conductive copper portions of the substrate.

Adhesion was determined by electroplating about 1 mil (25 microns) of coppeer onto the electroless copper layer, and the composite substrate was then mechanically destroyed in attempting to separate or peel the electroplate deposit.

EXAMPLE 2

Example 1 was repeated substituting a solution containing 7.5 gms of ammonium persulfate per liter of water for the hydrazine hydrate. The immersion time of the substrate was about 15 seconds. Substantially the same results were observed as set forth in Example 1.

EXAMPLE 3

Example 1 was repeated substituting a solution 0.5 gms of sodium hydroxide per liter of water for the hydrazine hydrate. The immersion time of the composite substrate was about 30 seconds. Again, substantially the same results were observed as set forth in Example 1.

I claim:

1. A method for promoting and improving the adhesion of an electroless metal deposit to the metal portion and a non-conductive portion which comprises treating the composite substrate with a copper type colloidal system to cause activation of the non-conductive portion thereof for electroless metal deposition, and thereafter treating the activated substrate, including the metal portions thereof, with an adhesion promoter compound selected from hydrazine hydrate, ammonium persulfate, or alkali hydroxide prior to the step of electroless deposition.

2. The method of claim 1 wherein the adhesion promoter is in solution and the concentration of the hydrazine hydrate is about 0.1% by volume to saturation, the concentration of the ammonium persulfate is about 0.5-10 gms per liter of solution and the concentration of the alkali hydroxide is about 0.1-5 grams per liter of solution.

3. The method of claim 2 wherein the substrate is treated with hydrazine hydrate for a period of time of about 1-3 minutes, with ammonium persulfate for a period of time not exceeding about 15 seconds and with sodium hydroxide for a period of time not exceeding about 30 seconds.

4. The method of claim 1 wherein the hydrazine hydrate is at a pH of about 7.

5. The method of claim 1 wherein the substrate is subsequently electroless plated with an electroless copper solution.

* * * * *